US009950341B2

(12) United States Patent
Wu et al.

(10) Patent No.: US 9,950,341 B2
(45) Date of Patent: Apr. 24, 2018

(54) SYSTEMS AND METHODS FOR FABRICATING SPIRAL COILS WITH ATOMIZED BIOACTIVE COATINGS

(71) Applicant: THE REGENTS OF THE UNIVERSITY OF CALIFORNIA, Oakland, CA (US)

(72) Inventors: Ben Wu, San Marino, CA (US); Arnold Suwarnasarn, Los Angeles, CA (US); Fernando Vinuela, Los Angeles, CA (US); Ichiro Yuki, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 309 days.

(21) Appl. No.: 14/567,152

(22) Filed: Dec. 11, 2014

(65) Prior Publication Data

US 2015/0165462 A1 Jun. 18, 2015

Related U.S. Application Data

(63) Continuation of application No. PCT/US2013/047713, filed on Jun. 25, 2013, and a (Continued)

(51) Int. Cl.

| | |
|---|---|
| ***B05D 3/02*** | (2006.01) |
| ***B05D 1/02*** | (2006.01) |
| *B05D 3/06* | (2006.01) |

(52) U.S. Cl.
CPC ..... *B05D 3/0254* (2013.01); *B05D 1/02* (2013.01); *B05D 3/06* (2013.01)

(58) Field of Classification Search
CPC ..... A61F 2/06; A61M 29/00; A61M 25/10; A61K 47/30

(Continued)

(56) References Cited

U.S. PATENT DOCUMENTS

2001/0047202 A1* 11/2001 Slaikeu ..... A61B 17/12022 623/1.46
2002/0040239 A1* 4/2002 Murayama ..... A61B 17/12022 623/1.34

(Continued)

FOREIGN PATENT DOCUMENTS

| | | |
|---|---|---|
| WO | 2004/096310 A2 | 11/2004 |
| WO | 2004/098671 A2 | 11/2004 |
| WO | 2008/045475 A1 | 4/2008 |

OTHER PUBLICATIONS

Korean Intellectual Property Office (KIPO), International Search Report and Written Opinion, dated Sep. 2, 2013, related PCT International Application No. PCT/US2013/047713, pp. 1-10, with claims searched, pp. 11-14.

(Continued)

*Primary Examiner* — Dah-Wei D Yuan
*Assistant Examiner* — Andrew Bowman
(74) *Attorney, Agent, or Firm* — O'Banion & Ritchey LLP; John P. O'Banion

(57) ABSTRACT

Systems and methods for coating of spiral intracranial aneurysm coils, e.g., a Guglielmi Detachable Coil (GDC), such that only selected surfaces along the spiral coil are coated with a polymer via an atomized polymer deposition process. The resulting device is a detachable aneurysm coil system which preserves the mechanical geometry and flexibility of the coil, and delivers specific agents to promote wound healing.

16 Claims, 6 Drawing Sheets

Related U.S. Application Data continuation-in-part of application No. PCT/US2012/044049, filed on Jun. 25, 2012.

(60) Provisional application No. 61/691,244, filed on Aug. 20, 2012, provisional application No. 61/505,470, filed on Jul. 7, 2011.

(58) Field of Classification Search
USPC ..... 623/1.34, 1.46, 1.11; 427/2.1, 2.3, 475, 427/2.24; 424/486; 118/627
See application file for complete search history.

(56) References Cited

U.S. PATENT DOCUMENTS

| | | | | |
|---|---|---|---|---|
| 2003/0143315 | A1* | 7/2003 | Pui | A61L 31/16 427/2.1 |
| 2004/0138695 | A1 | 7/2004 | Li et al. | |
| 2008/0020045 | A1* | 1/2008 | Chappa | A61L 27/58 424/486 |
| 2008/0124452 | A1 | 5/2008 | Kokish et al. | |
| 2008/0171129 | A1 | 7/2008 | Ranade et al. | |
| 2010/0004593 | A1* | 1/2010 | Gregorich | A61M 25/0012 604/96.01 |

OTHER PUBLICATIONS

European Patent Office (EPO), Extended European Search Report, dated Mar. 23, 2016, related EP Patent Application No. 13808854.7, pp. 1-7, with claims searched, pp. 8-10.

* cited by examiner

SYSTEMS AND METHODS FOR FABRICATING SPIRAL COILS WITH ATOMIZED BIOACTIVE COATINGS

CROSS-REFERENCE TO RELATED APPLICATIONS

This application is a 35 U.S.C. §111(a) continuation of PCT international application number PCT/US2013/047713 filed on Jun. 25, 2013, incorporated herein by reference in its entirety, which claims priority to, and the benefit of, U.S. provisional patent application Ser. No. 61/691,244 filed on Aug. 20, 2012, incorporated herein by reference in its entirety. PCT international application number PCT/US2013/047713 filed on Jun. 25, 2013 is a continuation-in-part of PCT international application serial number PCT/US2012/044049 filed on Jun. 25, 2012 and published as PCT International Publication No. WO 2013/006298 A2 on Jan. 10, 2013, incorporated herein by reference in its entirety. PCT international application serial number PCT/US2012/044049 filed on Jun. 25, 2012 claims priority to, and the benefit of, U.S. provisional patent application Ser. No. 61/505,470 filed on Jul. 7, 2011, incorporated herein by reference in its entirety. Priority is claimed to each of the foregoing applications.

PCT international application number PCT/US2013/047713 filed on Jun. 25, 2013 was published as PCT International Publication No. WO 2014/004579 on Jan. 3, 2014, which publication is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED IN A COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND

1. Technical Field

This technology relates generally to a bioactive coating on a medical device and methods of making and using the same, and more particularly to an intracranial aneurysm coil having a polymer coating on selected surfaces of the coil.

2. Background Discussion

Subarachnoid hemorrhage from intracranial aneurysm rupture remains a devastating disease. Endovascular occlusion of ruptured and unruptured intracranial aneurysms using Guglielmi Detachable Coil (GDC) technology has gained worldwide acceptance as a less-invasive treatment alternative to standard microsurgical clipping. However, critical evaluation of the long-term anatomical results of aneurysms treated with metal coils shows three limitations. First, compaction and aneurysm recanalization can occur. This technical limitation is more often seen in small aneurysms with wide necks and in large or giant aneurysms. Second, the standard platinum metal coil is relatively biologically inert. Research relating to methods of enhancing the biological activity of metal coils highlights the increased interest in finding innovative solutions to overcome these present biological limitations of the conventional metal coil system.

Polymeric coatings carrying a bioactive agent have been used to impart bioactivity to implantable devices (e.g., stents). However, when a polymeric coating is formed on a spiral coil, often times, the grooves of the spiral coil are coated along with the outer surface of the coil, causing the mechanical flexibility to be compromised, which is undesirable. Further, for a spiral coil to be spatially compatible with a vascular lumen in the brain, sometimes it is important to limit the diameter of a coil to a certain size since it is constrained by the inner diameter of the microcatheter used for placing the coil.

The technology of the present disclosure addresses the foregoing limitations of spiral intracranial aneurysm coils.

BRIEF SUMMARY

An aspect of this technology of the present disclosure comprises systems and methods for coating of spiral intracranial aneurysm coils, e.g., a Guglielmi Detachable Coil (GDC), such that only selected surfaces along the spiral coil are coated with a polymer via an atomized polymer deposition process. The resulting device is detachable aneurysm coil system which preserves the mechanical properties, flexibility, low friction, etc. to allow delivery, and low coil-coil entanglement to allow re-positioning of the coil, and delivers specific agents to promote wound healing.

The coated polymer coating may be bioactive, or may release a bioactive agent, or it may be of a type that reacts with the local environment to provide bulking function. Unlike liquid embolic agents, such as Onyx, which cannot be controlled in the context of placement or three dimensional shape, the coating material and processes of the technology of the present disclosure can be selected to remain in a solid state with defined shape and dimension for precise and accurate placement within the target.

This technology is compatible with existing coils (e.g. GDC's), which are already familiar to practitioners in the field. The technology of the present disclosure preserves the mechanical handling of existing coils, while adding a bioactive agent. To preserve the flexibility and deliver specific agents to promote wound healing, the coating process of the technology of the present disclosure minimizes and confines the location of the polymer coating layer such that it does not impede the coils flexibility. By leaving the grooves between each coil segment uncoated, the coating preserves the mechanical flexibility of the coil.

The polymer coating of the technology of the present disclosure provides two primary functions: to promote wound healing through intrinsic polymer properties, and to provide a potential vehicle for drug delivery. In addition, by employing post-processing techniques, the polymeric surface is improved to limit friction and wear of the coated surface.

Further aspects of the technology will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology of the present disclosure will be more fully understood by reference to the following drawings which are for illustrative purposes only:

DETAILED DESCRIPTION

In a preferred embodiment, the system and methods of the technology of the present disclosure are directed to atomized polymer deposition directly onto the surface of a Guglielmi Detachable Coil (GDC).

Figure 1:
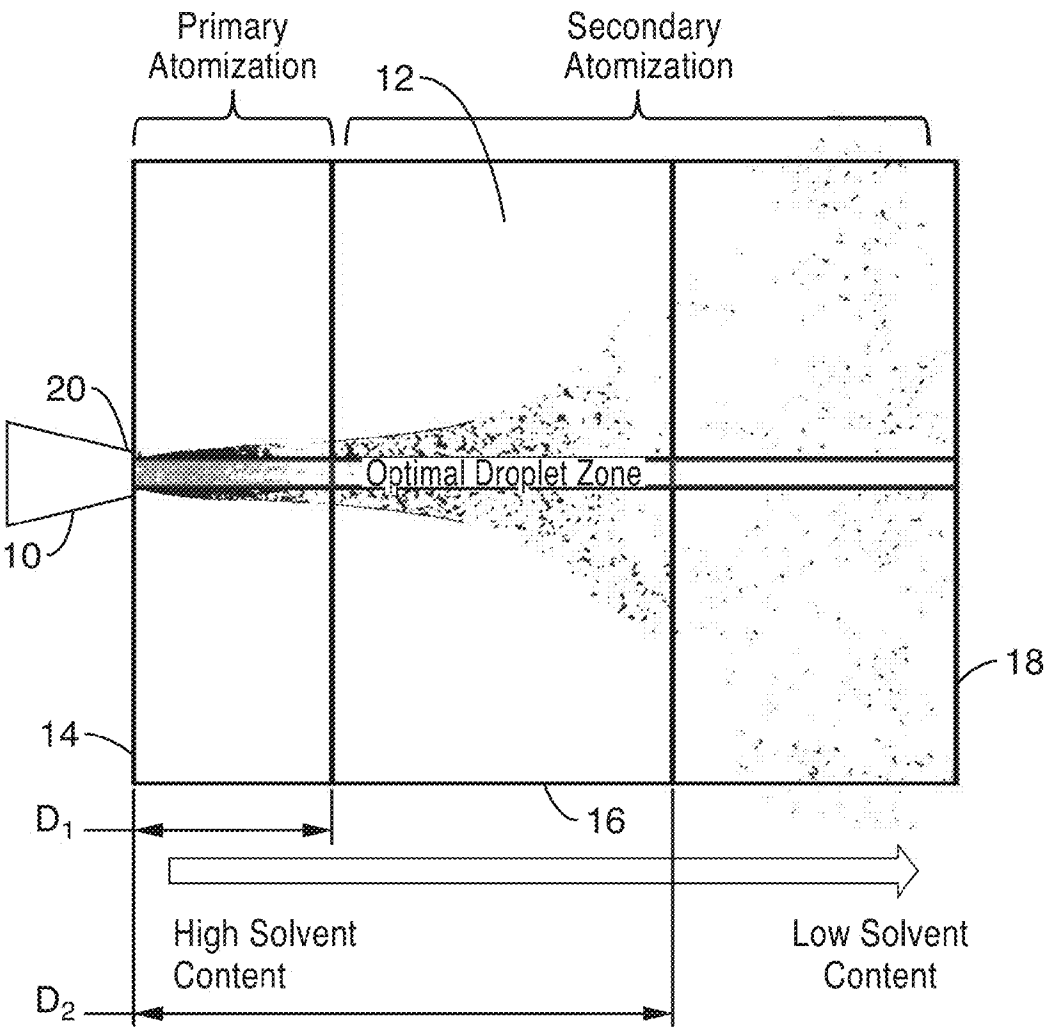
FIG. 1 is a side view of a nozzle performing atomized deposition in accordance with the technology of the present disclosure.

The polymer or combination of polymers is first solvated into a non-viscous solution. The GDC is elongated, along the coil axis, to create a linear target. The systems and methods of the technology of the present disclosure employ atomization techniques which can be separated into two key components: droplet breakup, and the influence of solvent evaporation. In order to achieve discrete spiral coating along the coil, precise control of the atomized polymer particles is important. In general, discrete spiral coating can be achieved if atomized particles are smaller than the gap between adjacent coil segments FIG. 1 is a side view of a nozzle 10 and corresponding atomized deposition droplet breakdown 12 in accordance with the technology of the present disclosure.

Droplet breakdown will be discussed first with reference to FIG. 1. Initially, atomized particles exiting distal end of nozzle 20 undergo primary atomization at region 14 that extends distance $D_1$ from the nozzle exit 20. The solution flow causes solution to exit the atomization nozzle 10, and dispensing air pressure causes initial breakup. In the primary atomization region 14, droplets are considered to be "immature," having a high solvent content and generally comprising large droplets (e.g. droplet 40 shown in FIG. 2A).

After primary atomization, secondary atomization takes place beyond distance D1 from the nozzle exit 20. The secondary atomization region comprises two sub-regions: 1) an optimal droplet zone 16 spanning from $D_1$ to distance $D_2$ from the nozzle exit 20, and 2) low-solvent region 18 extending beyond distance $D_2$ from the nozzle exit 20. In region 16, immature droplets break down further into smaller droplets (e.g. droplet 42 of FIG. 2A).

The other influential component of atomization involves the influence of solvent evaporation. Over time, solvent will evaporate. For an individual atomized particle, the longer time-of-flight a particle has, the more solvent will be removed from that particle. Particles begin as large and high solvent content droplets (primary atomization region 14), transition to smaller droplets with lower solvent content (optimal droplet region 16), and lastly transition to even smaller and tacky polymer spheres (low-solvent content region 18). For this reason, particles in the secondary atomization region, and in particular, the optimal droplet zone 16 that contains small particles and sufficient solvent to spread on the coil surface, are utilized for the discrete spiral coating of the technology of the present disclosure.

In a preferred configuration, atomization is configured such that the droplets display low viscosity and low surface tension with respect to the coil material. The amount/concentration of solvent will generally control viscosity, which scales with surface tension. For example, for the same polymer-solvent system, more solvent would lower viscosity and surface tension, which produce better spreading and adhesion to substrate. Incidentally, the reservoir of the sprayer may also be heated to decrease viscosity, surface tension, and also make finer droplets because of faster solvent evaporation. Increasing the air-liquid flow ratio will also increase evaporation and make smaller droplets, but without thermal energy the viscosity and surface tension would increase. Since wetting is the final desired result, in a preferred embodiment the droplet in the optimized zone 16 is ideally configured to produce a wetting angle of less than 30 degrees on the coil substrate.

Figure 2C:
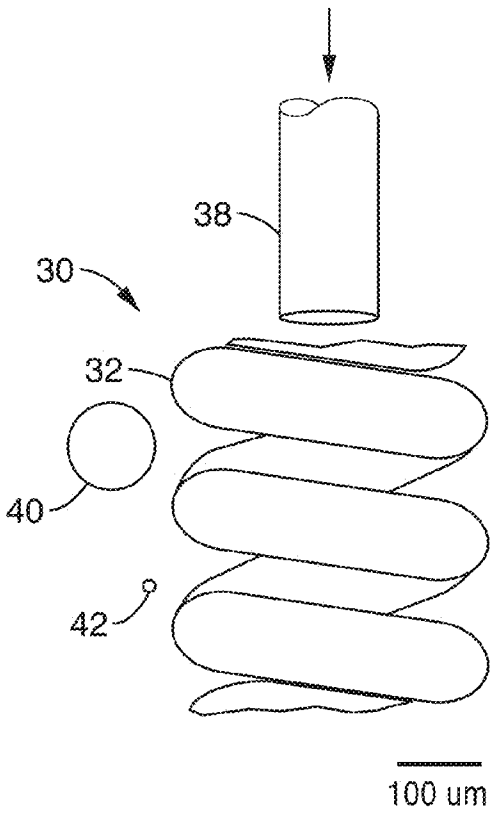
FIG. 2C is a side view of a GDC of FIG. 2B with use of a mandrel
Figure 2B:
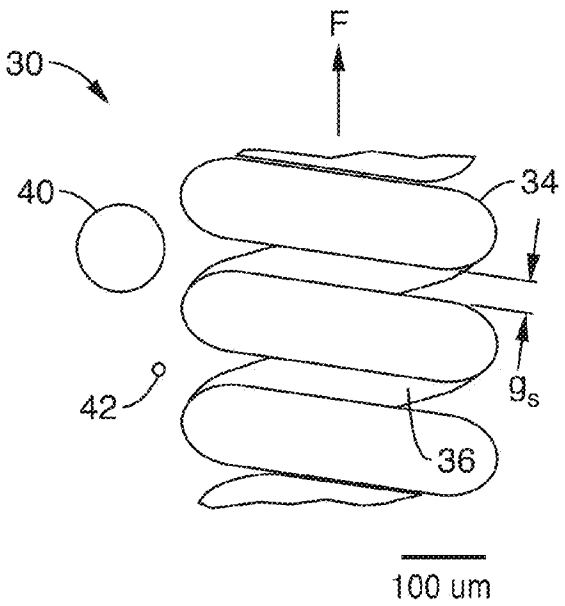
FIG. 2B is a side view of a GDC of FIG. 2A in a stretched state.
Figure 2A:
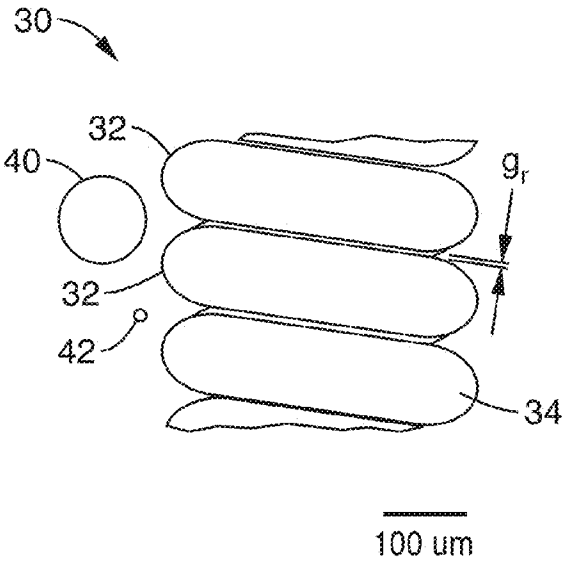
FIG. 2A is a side view of a GDC in a resting state, as compared to droplet size of the deposited coating.

FIG. 2A through FIG. 2C illustrate the importance of droplet size control and coil stretching with respect to GDC 30. Spiral coating by atomized polymer deposition can be created using any GDC size, and thus the scale bar is provided for reference only.

In FIG. 2A, GDC 30 is not stretched (e.g. groove having spacing $g_r$). Sphere 40 represents a large, non-optimal droplet which will cover and occlude the helical gap or grooves of the GDC coil 30 and will not produce a discrete spiral coating. For purposes of this description, "occlusion" of the helical gap refers to a continuous or semi-continuous coating layer across the helical gap so as to close off the gap from one segment 32 to an adjacent segment, which may result in binding the coil 30 to restrict motion of the coil segments with respect to each other. Sphere 42 represents a small optimal droplet, in accordance with droplets disposed within optimal droplet zone 16 of FIG. 1, that are configured to more likely produce a discrete spiral coating on the outer surface 34 of the individual segments 32 of coil 30. Based on the resting gap/groove size $g_r$, the grooves of the GDC coil may still be occluded, even with the smaller droplet size 42.

In accordance with a preferred method of the technology of the present disclosure illustrated in FIG. 2B, the GDC coil 30 is stretched via application of tensile force F along the coil axis to increase the distance $g_s$ between adjacent coil segments 32 to create a linear target for deposition, as well as increase the gap between adjacent wire segments 32 to thereby increase coating efficiency for discrete spiral coating outer surface 34. Generally, the vast majority of the deposited coating is restricted to outer surface 34, leaving the inner surface 36 with a minimal amount of coating.

As shown in FIG. 2C, a mandrel 38 may optionally be inserted down the center of coil 30 to further mask internal surface 36 from deposition.

Figure 3C:
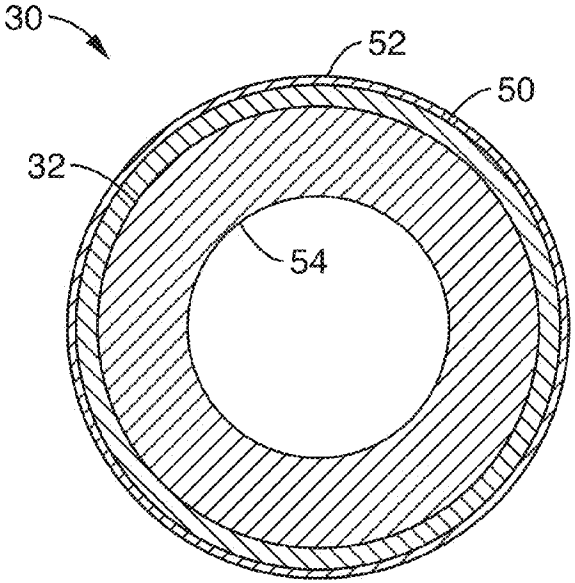
FIG. 3C is a cross-sectional view of the GDC of FIG. 3B coated with a lubricant.
Figure 3B:
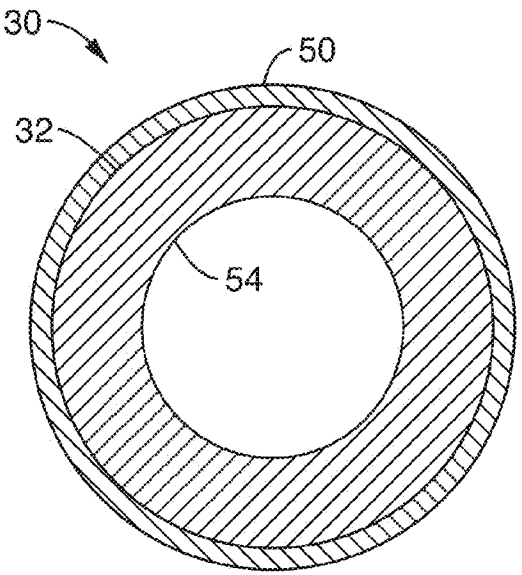
FIG. 3B is a cross-sectional view of the GDC of FIG. 3A coated with a bioactive polymer.
Figure 3A:
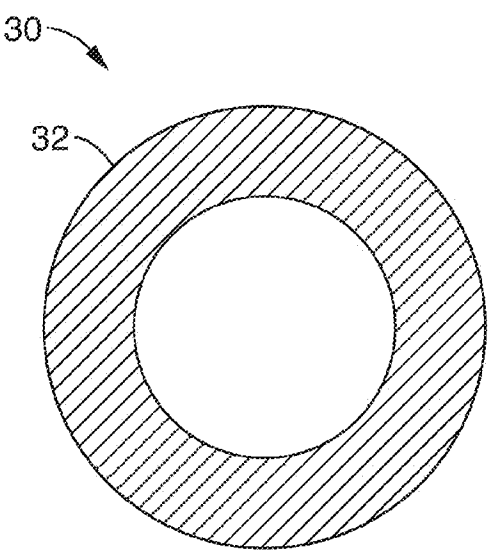
FIG. 3A is a cross-sectional view of an uncoated GDC.

FIG. 3A through FIG. 3B illustrate cross-sectional views of coil 30 through various stages of the coating process of the technology of the present disclosure. FIG. 3A shows a view of the uncoated coil 30 showing only the metallic of coil segments 32. FIG. 3B illustrates the outside surface of segments 32 coated with bioactive polymer layer 50. It should be noted that inner surface 54 is substantially free of coating. FIG. 3B illustrates the outside surface of segments 32 coated with bioactive polymer layer 50 and lubricant layer 52. Again, inner surface 54 is substantially free of coating.

Figure 4B:
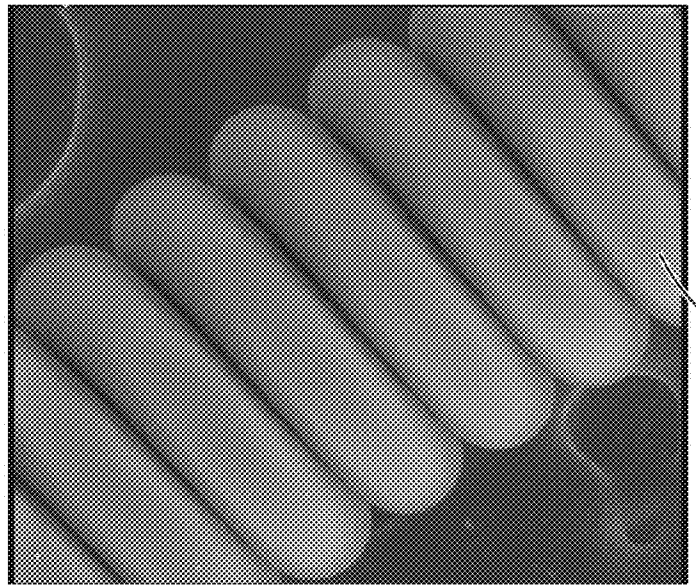
FIG. 4A and FIG. 4B show images of uncoated and coated GDC's respectively.
Figure 4A:
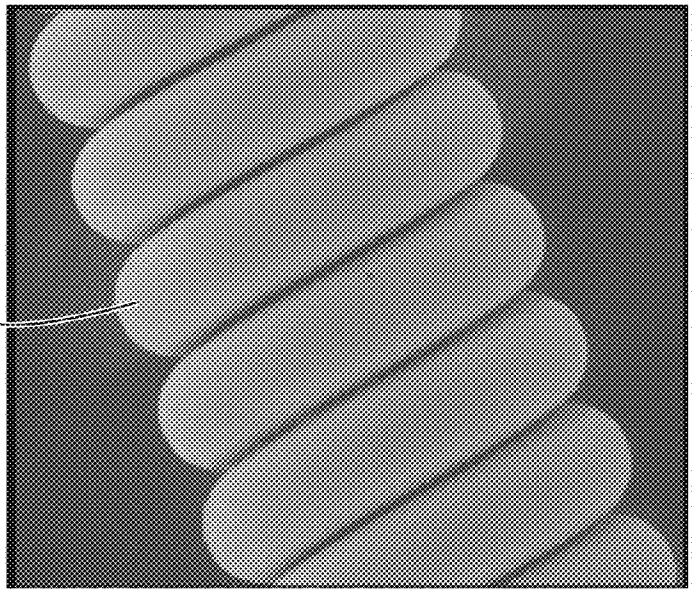

FIG. 4A shows a SEM image of an uncoated GDC 30. FIG. 4B shows a SEM image of the coated GDC 30 with bioactive polymer 50 in accordance with the processes of the technology of the present disclosure. As seen in FIG. 4B, the coating is smooth, homogenous, even, and covers the exterior of the metallic surface, leaving the helical grooves/gap substantially free from occlusion of the polymer, i.e. devoid of polymer.

Figure 5:
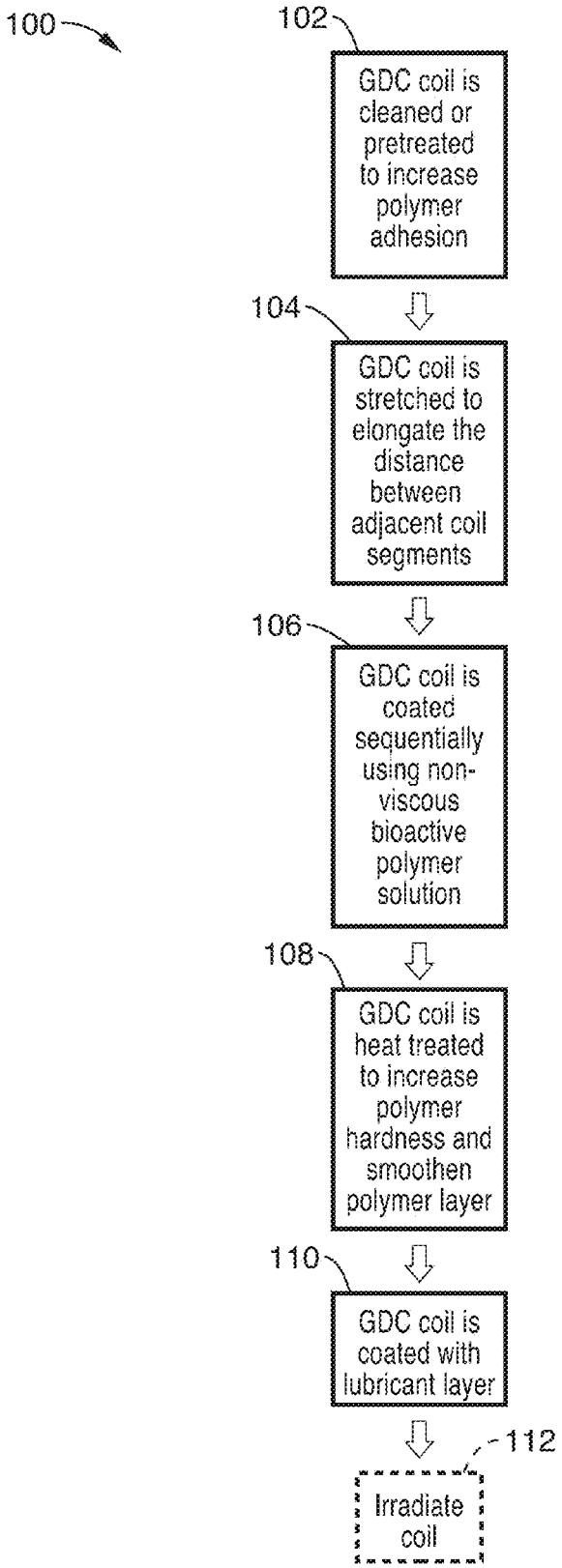
FIG. 5 is a flow diagram of a coating process in accordance with the technology of the present disclosure.

FIG. 5 is a flow diagram of a coating process 100 in accordance with the technology of the present disclosure. Method 100 may be used in conjunction with deposition system 150 shown in FIG. 6 for the coating of a target such as GDC 30.

First, at block 102, the coil 30 is optionally pretreated, e.g. with a cleansing solution, to increase polymer adhesion.

In a preferred embodiment, the coils 32 of GDC 30 are stretched elastically along the coil axis at step 104, as shown in FIG. 2B. Doing so creates a linear target, as well as increases the gap $g_s$ between adjacent coil segments 32.

Figure 6:
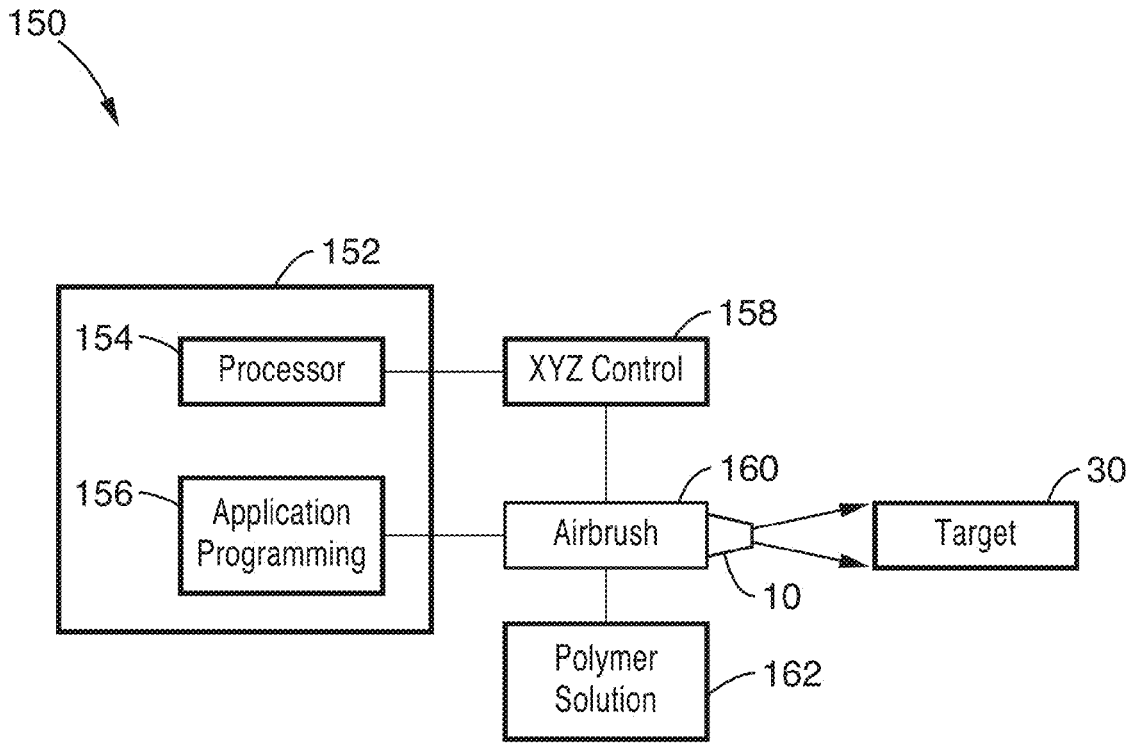
FIG. 6 is a schematic diagram of a deposition system in accordance with the technology of the present disclosure.

Next, at step 106, the external surface 34 of coil 30 is discretely coated sequentially using a non-viscous bioactive polymer solution 162 (FIG. 6).

Parameters which influence discrete spiral coating include: solution viscosity, solvent evaporation rate, spray distance away from target (e.g. within optimal droplet zone 16), and rate of polymer deposition.

Factors which influence particle size are: solution surface tension, dispensing air pressure, solution flow rate, deposition rate, and atomization technique employed. By manipulating these variables, atomized polymer droplets 42 can be created small enough such that these particles are smaller than the gaps between adjacent wire segments 32.

In one embodiment, a 1% acidic 50:50 PLGA solution 162 in acetone (w/w) is created. In one embodiment, the following solution dispensing parameters may be used using conventional air-assisted atomization:

(a) Air Pressure: 15 PSI to 25 PSI, (b) Solution flow rate per airbrush: 0.001 g/s to 0.01 g/s, (c) Airbrush-to-target distance: 2 cm to 5 cm (e.g. distance $D_1$ to $D_2$ from nozzle exit 20), (d) Translational velocity: 1 cm/s to 10 cm/s.

Angular tilting (in x-y-z, and use of hydraulic airbrushes may also be considered. It is appreciated that the above parameters are variable, and may vary according to deposition technique, solution, coil size, etc.

The solution 162 is then loaded into one or more airbrushes 160 (e.g. an array of 3 airbrushes) attached to a robotic polymer atomizing robot (x-y-z control 158). The robot 158 is controlled by a computer 152 having a processor 154 and programming 156 executable on the processor to modulate solution flow rate, deposition rate (controlled by vertical velocity along the coil axis), and the number of layers. The robot 158 can be mechanically modified to control droplet time-of-flight by moving the airbrush 160 closer to or away from the target 30.

In one embodiment, ultrasonic atomization may also be used to achieve the discrete spiral coating of step 106 by modulating additional parameters specific to the ultrasonic atomization process: e.g. amplitude and frequency.

Using these parameters, polymer is imparted onto the GDC surface 34 in incremental layers. However, it is important to note that before a subsequent layer is deposited, the previous layer should be allowed to dry for a short period of time before the next layer is deposited.

Post processing steps may also be applied to the coil surface to improve final polymer characteristics which include: polymer smoothness, discrete coil coating, and polymer durability.

In one embodiment, drying the polymer surface can be achieved at step 108 with heated or unheated air, infrared heat, or reducing surrounding air pressure.

The number of polymer layers deposited will dictate the final thickness. Discrete spiral coating can be maintained up to 20 μm in thickness by utilizing atomized polymer deposition. However, using thinner polymer layers is preferred to maintain coil flexibility and limit polymer fragmentation. A sacrificial gap layer may also be incorporated.

In one embodiment, after the coils have been coated, the coils 30 are then transferred to an oven set at 37° C. and allowed to dry overnight. Coils 30 are then heat set above their glass transition temperature for a short period. The heat setting step 108 performs two primary functions. The first is to create a smooth surface due to stray particles by the atomization process. The second is to improve polymer hardness, by alignment of crystalline regions.

Additional post-processing steps may be utilized to increase other polymer coating properties. A protective/lubricant polymer layer 52 may be deposited at step 110 such that the PLGA layer is protected during handling and delivery. Protective or lubricant coatings 52 may be in liquid state or solid state, but also preserve coil flexibility during deployment. Exemplary lubricants include, but are not limited to: hypromellose, carboxymethyl cellulose, Eudragit S100, etc.

Final polymer characteristics may be improved at step 112 by radiation treatment to induce polymer cross-linking and provide sterilization. Gamma radiation may be used to increase polymer hardness and to address other handling and durability characteristics. Irradiation may also comprise electron beam, UV, or other sources available in the art.

The technology of the present disclosure described in FIG. 1 through FIG. 6 above may also incorporate, or be combined with the inventive concepts and embodiments described in our prior PCT international patent application PCT/US2012/044049 filed on Jun. 25, 2012 and published as PCT International Publication No. WO 2013/006298 A2 on Jan. 10, 2013.

In one embodiment, an endovascular device comprises a metallic spiral coil 30 and a coating 50 on the coil wherein the coating is formed on the outer surface 34 of the spiral coil only such that the grooves of the coil remain uncoated and substantially free of the coating.

In some embodiments of the endovascular device, the metallic spiral coil 30 comprises platinum, tungsten, titanium, silver, stainless steel, zirconium, or an alloy thereof. In some embodiments, the metallic spiral coil 30 comprises Nitinol, polymers, or a biodegradable metal or alloy (e.g., magnesium or an alloy thereof).

In some embodiments of the endovascular device, optionally in combination with any or all of the above various embodiments, the coating 50 comprises a bioabsorbable polymer or a biodurable polymer. In some embodiments, the bioabsorbable polymer comprises a polyester polymer, e.g., polyglycolic acid (PGA), poly-L-lactic acid (PLLA), polycaprolactive, poly-L-lactide, polydioxanone, polycarbonates, polyanhydrides, polyglycolic acid/poly-L-lactic acid copolymers, and polyhydroxybutyrate/hydroxyvalerate copolymers, or combinations thereof.

In some embodiments, the biodurable polymer comprises polyacrylate, polymethacrylate, polyether, or a fluorinated polymer.

In some embodiments, the polymer can be polylactone, poly-alpha-hydroxy acids, poly(3-hydroxyalkanoates), polyglycols, polytyrosine carbonates, starch, gelatins, cellulose as well as blends and interpolymers containing these components. Examples of poly-alpha-hydroxy acids are polylactides, polyglycol acids, and their interpolymers.

In some embodiments, the polymer can be caprolactone/glycolide copolymer or calcium stearoyl lactylate. Calcium stearoyl lactylate degrades into stearic and lactic acids. The polymer can also be acidic polyesters, such as a mixture of PLGA and hydroxyacetic acid (about equivalent molar ratios), or polyester anhydrides such as glycolic acid, lactic acid, or sebacic acid polymers.

In some embodiments of the endovascular device, optionally in combination with any or all of the above various embodiments, the coating 50 further comprises a bioactive agent.

In some embodiments of the endovascular device, optionally in combination with any or all of the above various embodiments, the coating 50 comprises a drug matrix layer comprising a bioactive agent, an optional primer layer underneath the drug matrix layer, and an optional a top layer immediately over the drug matrix layer, and wherein the optional top layer provides a controlled release of the bioactive agent.

In some embodiments of the endovascular device, optionally in combination with any or all of the above various embodiments, the coating 50 further comprises a biobeneficial material that enhances biocompatibility of the coating. Such biobeneficial material can be any material capable of enhancing biocompatibility of the coating. Examples of such biobeneficial material can be, e.g., a material that comprises choline, e.g., phosphoryl choline.

The various above embodiments of the endovascular device can be any endovascular device. In some embodiments, the device is a detachable aneurysm coil. In some embodiments, the device is a bare platinum coil.

In another aspect of the technology of the present disclosure, there is provided a method of forming a coating on an endovascular device. The device comprises a spiral coil body. The method comprises: forming a primary layer on the coil using a first solution comprising a primary layer material in a first solvent; removing the primary layer from the grooves of the spiral coil; forming a second layer on the outer surface of the spiral coil; using a second solution comprising a second layer material and a second solvent; drying the second layer; removing the primary layer from the grooves of the spiral coil; and drying the coating; wherein the primary layer material does not dissolve in the second solution and is not wet well by the second solution; and wherein the coating covers only the outer surface of the spiral coil.

Some embodiments of the method further comprise treating the coating with a solvent vapor to produce a smooth even coating.

In some embodiments of the method, optionally in combination with any or all of the above various embodiments, an additional lubricant layer may be deposited on top of the second polymer layer, which imparts additional advantages or desirable properties to the coating, e.g., to prevent damage to the polymer layer during storage, to confer polymer integrity during deployment, and/or to decrease friction during deployment. In some embodiments, the lubricant layer can also contain pro-inflammatory factors embedded within the lubricant layer, or possess inherent pro-inflammatory properties.

In general any combination of solvents can be used for the first or second solvent as long as they do not mix together, which is shown by high interfacial tensions and present disparate solubility parameters. In addition, the solvents must dissolve their respective polymers. The only first solvent we have tested was water. Second solvents that we have tested were: 1,2 Dichloroethane, 2-Phenoxyethanol, Acetone, Acetonitrile, Benzaldehyde, Benzonitrile, Benzyl alcohol, Chloroform, Dichloromethane, Dimethyl Adipate, Dimethyl sulfoxide, Dimethylformamide, Dioxane, Ethyl acetate, Hexafluoroisopropanol, Propylene carbonate. First and second solvents were chosen based on similar Hansen solubility parameters as the primary or secondary polymer, respectively. In some embodiments of the method, the first solvent is water, and the second solvent is chloroform.

In some embodiments of the method, optionally in combination with any or all of the above various embodiments, the primary layer material is dextran sulfate. Other materials for the primary layer material can be, e.g., polyethylene glycol, polyvinyl Alcohol, polyacrylic acid, polyvinylpyrrolidone, polyacrylamide, carboxymethyl cellulose, guar gum, hypromellose, glucose, polyvinyl sulfate, polyvinyl phosphonic acid, mowiol, hydroxyethyl cellulose, dextran, dextran sulfate, glycolide, pullan, starch, xylan, polyallylamie, polyepoxysuccinic acid, amylose, galactan, cellulose, gelatin, pectin, chitosan. The second layer material comprises a bioabsorbable polymer or a biodurable polymer. In some embodiments, the bioabsorbable polymer comprises a polyester, e.g., poly(lactic acid) (PLA), poly(lactic-co-glycolic acid) (PLGA), or a combination thereof. In some embodiments, the biodurable polymer comprises polyacrylate, polymethacrylate, polyether, or a fluorinated polymer. In some embodiments, the polymer can be polylactone, poly-alpha-hydroxy acids, poly(3-hydroxyalkanoates), polyglycols, polytyrosine carbonates, starch, gelatins, cellulose as well as blends and interpolymers containing these components. Examples of poly-alpha-hydroxy acids are polylactides, polyglycol acids, and their interpolymers. In some embodiments, the polymer can be caprolactone/glycolide copolymer or calcium stearoyl lactylate. Calcium stearoyl lactylate degrades into stearic and lactic acids.

In some embodiments of the method, optionally in combination with any or all of the above various embodiments, the second layer polymer comprises a material that generates a transient and mild inflammation so as to accelerate wound healing. Examples of such pro-inflammatory coating materials are acidic polyesters which are examples of pro-inflammatory coating materials that can accelerate healing. The polymer can also be acidic polyesters, such as a mixture of PLGA and hydroxyacetic acid (about equivalent molar ratios), or polyester anhydrides such as glycolic acid, lactic acid, or sebacic acid polymers. In some embodiments, where the second layer polymers are not inflammatory, the coating may contain fillers or particles that happen to cause transient and mild inflammation.

In the method, the various features of the spiral coil including the polymer, the coating, the layers of coating, and the bioactive agent are as described above or below.

In the method, the various above embodiments of the endovascular device can be any endovascular device. In some embodiments, the device is a detachable aneurysm coil. In some embodiments, the device is a bare platinum coil.

In one embodiment, there is provided a method of forming a coating on a spiral coil. The method comprises pre-stretching and without pre-stretching techniques such as rolling, spraying, stamping, printing, etc. Other coating techniques include: direct dip coating, roll coating, spray coating, and geometric printing. All of these techniques—including the technique described above and below—may require the spiral coil to be stretched along the coil axis, prior to the coating methods, to expose the grooves such that the final coating is deposited exclusively on the coil surface.

Information on exemplary alternative coating techniques is provided below:

Direct dip coating—a spiral coil is immersed in a polymer solution (with appropriate solvent), withdrawn from the solution, and allowed to dry.

Roll coating—bioactive polymer is applied to a flat rubber stamping device. The bioactive polymer is applied to the spiral coil by touching the rubber stamp to an elongated spiral coil. The rubber stamp moves linearly along the coil, such that it rolls the coil. During this motion, the polymer releases from the rubber stamp, and is applied to the spiral coil.

Spray coating—a solution of bioactive polymer is prepared and is deposited onto the spiral coil surface by atomization. This process is similar to airbrushing or spray painting.

In some embodiments of the method of making a spiral coil, optionally in combination with any or all of the above various embodiments, the method comprises an optional step. This step will precede all coating steps. This step pertains to direct modification of the metal surface such that it increases the adhesion of the polymer to the metal surface. This technique can be achieved by increasing the surface area of the spiral coil, or increasing wetting of the polymer solution to the metal surface. Techniques to increase the surface area of the metal surface include: surface abrasion or acid etching. Techniques to increase the wetting of the polymer solution to the metal surface include plasma etching, plasma treatment, and surface cleaning.

In another embodiment, there is provided a method of treating or ameliorating a medical condition. The method comprises implanting in a mammalian subject an endovascular device according to any of the various embodiments described above or below. In some embodiments, the medical condition is intracranial aneurysm rupture.

The technology of the present disclosure is advantageous in that it allows the modification of bare metallic coils (e.g., bare platinum coils) such that only selected surfaces along the spiral coil is coated with a polymer. This polymer coating can be bioactive, or may release a bioactive agent, or it may react with the local environment to provide bulking function. By leaving the grooves between each coil segment uncoated, the coating preserves the mechanical flexibility of the coil. The technology of the present disclosure can be applied to any currently available coil systems for the treatment of any medical condition that can be treated by an endovascular coil. An example of such medical conditions is brain aneurysms. The technology of the present disclosure will allow the coil material or system to have additional bioactive coating without impeding its mechanical property. Relatively large aneurysms will be treated more effectively so as to achieve less recanalization rate and improved treatment rate.

Additionally, the endovascular device provided herein is capable of generating a transient and mild inflammation condition at a site receiving the device or the surrounding area. A transient and mild inflammation condition can facilitate healing of a wound in a site receiving a device of the technology of the present disclosure. In some embodiments, acid polyesters can be coated onto a device disclosed herein to generate transient and mild inflammation at the site receiving the device.

Definitions

Unless otherwise stated, the following terms used in this application, including the specification and claims, have the definitions given below. It must be noted that, as used in the specification and the appended claims, the singular forms "a," "an" and "the" include plural referents unless the context clearly dictates otherwise. The practice of the technology of the present disclosure will employ, unless otherwise indicated, conventional methods of protein chemistry, biochemistry, and pharmacology, within the skill of the art. Such techniques are explained fully in the literature. See, e.g., T. E. Creighton, Proteins: Structures and Molecular Properties (W.H. Freeman and Company, 1993); A. L. Lehninger, Biochemistry (Worth Publishers, Inc., current addition); Remington's Pharmaceutical Sciences, 18th Edition (Easton, Pa.: Mack Publishing Company, 1990); each of which is incorporated herein by reference in its entirety.

The terms "effective amount" or "pharmaceutically effective amount" refer to a nontoxic but sufficient amount of the agent to provide the desired biological result. That result can be reduction and/or alleviation of the signs, symptoms, or causes of a disease, or any other desired alteration of a biological system. For example, an "effective amount" for therapeutic uses is the amount of the composition comprising a drug disclosed herein required to provide a clinically significant modulation in the symptoms associated with vascular permeability. An appropriate "effective amount" in any individual case may be determined by one of ordinary skill in the art using routine experimentation.

As used herein, the terms "treat" or "treatment" are used interchangeably and are meant to indicate a postponement of development of a disease associated with vascular permeability and/or a reduction in the severity of such symptoms that will or are expected to develop. The terms further include ameliorating existing symptoms, preventing additional symptoms, and ameliorating or preventing the underlying metabolic causes of symptoms.

The term "polymer" is defined as being inclusive of homopolymers, copolymers, and oligomers. The term "homopolymer" refers to a polymer derived from a single species of monomer. The term "copolymer" refers to a polymer derived from more than one species of monomer, including copolymers that may be obtained by copolymerization of two monomer species, those that may be obtained from three monomers species ("terpolymers"), those that may be obtained from four monomers species ("quaterpolymers"), etc. Some examples of polymers are bioabsorbable polymers and biodurable polymers. Further, as used herein, the term "polymer" includes any polymers that either directly, or indirectly by their degradation products will promote at least 25% increase in activities of neutrophils, macrophages, or other lymphocytes. Generally, such polymers do not include a polymer that tends to stick to itself when wet, as this would cause coil-coil friction during deployment and retrieval.

In some embodiments, the bioabsorbable polymer comprises a polyester, e.g., poly(lactic acid) (PLA), poly(lactic-co-glycolic acid) (PLGA), or a combination thereof or poly polyorthoesters. Bioabsorbable polymers can have acid, base, hydroxyl, or ester functional groups as side groups (pendant groups) or at one or both ends of the polymer backbone, which can also be referred to as acid-terminated, base-terminated, hydroxyl terminated, or ester terminated polymer. These polymers can be readily prepared according to established methodologies of polyester preparation. For example, acid terminated polyester can be readily prepared by using a diacid as the initiator in the preparation of the polyester. Likewise, amine-terminated (base-terminated), hydroxyl-terminated or ester-terminated polyester polymers can be readily prepared using a diamine, diol or an ester having a free hydroxyl group initiator in the preparation of the bioabsorbable polymer (e.g., PLA, PLGA, polyorthoester), respectively.

In some embodiments, the bioabsorbable polymer includes polymers that break down into acidic/basic monomers (e.g., PLA or polyorthoesters). The degradation products of these polymers can cause slightly inflammatory reactions.

In some embodiments, the biodurable polymer comprises polyacrylate, polymethacrylate, polyether, or a fluorinated polymer.

The term "poly(lactic acid-co-glycolic acid)" or "PLGA" refers to a copolymer formed by copolycondensation of lactic acid, HO—CH($CH_3$)—COOH, and glycolic acid, HO—$CH_2$—COOH.

As used herein, the term "subject" encompasses mammals and non-mammals. Examples of mammals include, but are not limited to, any member of the Mammalian class: humans, non-human primates such as chimpanzees, and other apes and monkey species; farm animals such as cattle, horses, sheep, goats, swine; domestic animals such as rabbits, dogs, and cats; laboratory animals including rodents, such as rats, mice and guinea pigs, and the like. Examples of non-mammals include, but are not limited to, birds, fish and the like. The term does not denote a particular age or gender.

By "substantially free" is meant that at least 80% or more (e.g., 90% or more, 95% or more, or 99%) area of the grooves of the spiral coil remain uncoated. Conversely, in some embodiments, by "substantially free" is meant that at least 80% or more (e.g., 90% or more, 95% or more, or 99%) area of the outer surface of the spiral coil remains uncoated.

By "does not dissolve" is meant the primary layer material has a solubility in the second solvent of lower than 1 g/100 cc.

By "is wet not well" is meant the primary layer and the second solution has a contact angle (θ) that is 90° or larger (θ≥90°). The contact angle is the angle at which the liquid-vapor interface meets the solid-liquid interface. The contact angle is determined by the resultant between adhesive and cohesive forces. As the tendency of a drop to spread out over a flat, solid surface increases, the contact angle decreases. Thus, the contact angle provides an inverse measure of wettability. Adhesive forces between a liquid and solid cause a liquid drop to spread across the surface. Cohesive forces within the liquid cause the drop to ball up and avoid contact with the surface.

As used herein, the term "bioactive agent" can be any biologically active molecule. Any biologically active substance can be used as the source of biologically active molecules. Representative examples include laminin and growth factors such as IGF (insulin-like growth factors), TGF (transforming growth factors), FGB (fibroblast growth factors), including b-FGF (basic fibroblast growth factors), EGF (epidermal growth factors), VEGF (vascular endothelial growth factors), BMP (bone morphogenic proteins), PDGF (platelet-derived growth factors), or combinations thereof. These growth factors are well known and are commercially available.

The term "coil" can be any type of coil known in the art, such as, for example, a Guglielmi detachable coil (GDC). The coil can be coated with an absorbable polymeric material to improve long-term anatomic results in the endovascular treatment of intracranial aneurysms. The coil can further be coated to decrease friction to decrease the granulation tissue formation around the coils. In one embodiment, the coating comprises at least one biocompatible and bioabsorbable polymer and growth factors, and is used to accelerate histopathologic transformation of unorganized clots into fibrous connective tissue in aneurysms.

As used herein, the term "solvent vapor" generally refers to the vapor of a volatile solvent capable of dissolving a polymer for forming the second layer of a coating disclosed herein. The volatile solvent can be the same as or different from the solvent for the second solution for forming the second layer of coating. An example of the volatile solvent is acetone. Another example of the volatile solvent is ethyl acetate.

As used herein, the term "transient and mild inflammation" refers to an inflammatory condition limited to the site of tissue receiving a device disclosed herein and the surrounding area that would disappear or clear in a short period of time, e.g., hours or days. Such transient and mild inflammation is within the knowledge of a medical practitioner or researcher and can be measured by, e.g., a slight elevation of temperature (e.g., an increase of temperature of 0.5 F, 1 F, 1.5 F, or 2 F) at the site of tissue receiving the device and the surrounding area.

EXAMPLES

The following examples are illustrative and not limiting.

In one example of forming a coating on a platinum/tungsten coil, the first step is performed by immersing the entire coil in an aqueous solution of dextran sulfate to form a primary layer, and then drawing the coil through a small aperture in a Teflon tape at controlled draw velocity to remove excess dextran sulfate. This first step confines the primary layer to the grooves of the coil. This dextran-coated coil is subsequently immersed and drawn from a polymer/chloroform solution (e.g., acid modified PLGA). The dextran sulfate can be replaced by any other polymer that does not dissolve in the second solution, and is not wet well by the second solution. After the PLGA is dried, the coil is immersed in water to remove the primary layer, and then dried. The coil is then flexed to remove any PLGA that has spanned over the grooves. Lastly the coil is exposed to acetone vapor to produce a smooth even coating which only covers the outer coil surface.

From the discussion above it will be appreciated that the technology can be embodied in various ways, including the following:

An endovascular device, comprising: a metallic spiral coil and a coating on the coil; wherein the coating is formed only on the outer surface of the spiral coil such that the grooves of the coil remain uncoated and substantially free of the coating.

The endovascular device of any previous embodiment, wherein the metallic spiral coil comprises platinum, tungsten, titanium, silver, stainless steel, zirconium, or an alloy thereof.

The endovascular device of any previous embodiment, wherein the coating comprises a bioabsorbable polymer or a biodurable polymer.

The endovascular device of any previous embodiment, wherein the coating further comprises a bioactive agent.

The endovascular device of any previous embodiment: wherein the coating comprises a drug matrix layer comprising a bioactive agent, an optional primer layer underneath the drug matrix layer, and an optional top layer immediately over the drug matrix layer, and wherein the optional top layer provides a controlled release of the bioactive agent.

The endovascular device of any previous embodiment, wherein the coating comprises polyester.

The endovascular device of any previous embodiment, wherein the coating comprises a bioabsorbable polymer selected from the group consisting of poly(lactic acid) (PLA), poly(lactic-co-glycolic acid) (PLGA), or a combination thereof, or a biodurable polymer selected from the group consisting of polyacrylate, polymethacrylate, polyether, or a fluorinated polymer.

The endovascular device of any previous embodiment, wherein the coating comprises a biobeneficial material that enhances biocompatibility of the coating.

The endovascular device of any previous embodiment, wherein the coating comprises choline.

The endovascular device of any previous embodiment, wherein the coating comprises a pro-inflammatory material that generates a transient and mild inflammation.

The endovascular device of any previous embodiment, wherein the coating comprises an acid polyester or a filler material or particles.

The endovascular device of any previous embodiment, wherein the coating comprises a lubricant layer deposited on top of a polymer layer.

The endovascular device of any previous embodiment, wherein the coating comprises a lubricant layer deposited on a polymer layer, and wherein a pro-inflammatory material is embedded within the lubricant layer.

The endovascular device of any previous embodiment, wherein the coating includes a lubricant layer that possesses inherent pro-inflammatory properties.

The endovascular device of any previous embodiment, wherein the device is a detachable aneurysm coil.

The endovascular device of any previous embodiment, wherein the device is a platinum coil.

A method of forming a coating on an endovascular device, the device comprising a spiral coil body, the method comprising: forming a primary layer on the coil using a first solution comprising a primary layer material in a first solvent, removing the primary layer from the grooves of the spiral coil or the outer surface of the spiral coil, forming a second layer on the grooves of the spiral coil or on the outer surface of the spiral coil using a second solution comprising a second layer material and a second solvent, drying the second layer, removing the primary layer from the grooves of the spiral coil or the outer surface of the spiral coil, and drying the coating, wherein the primary layer material does not dissolve in the second solution and is not wet well by the second solution, and wherein the coating covers only the outer surface of the spiral coil.

The method of any previous embodiment, further comprising treating the coating with a solvent vapor to produce a smooth even coating.

The method of any previous embodiment, further comprising pre-treating surface of the spiral coil body.

The method of any previous embodiment, wherein the first solvent is water, and wherein the second solvent is chloroform.

The method of any previous embodiment, wherein the primary layer material is dextran sulfate, and wherein the second layer material is a poly(lactic acid) (PLA), poly (lactic acid-co-glycolic acid) (PLGA), or a combination thereof.

The method of any previous embodiment, wherein the spiral coil is a metallic spiral coil comprising platinum, tungsten, titanium, silver, stainless steel, zirconium, or an alloy thereof.

The method of any previous embodiment, wherein the second layer comprises a bioabsorbable polymer or a biodurable polymer.

The method of any previous embodiment, wherein the second layer further comprises a bioactive agent.

The method of any previous embodiment, wherein the coating comprises a drug matrix layer comprising a bioactive agent, an optional primer layer underneath the drug matrix layer, and an optional a top layer immediately over the drug matrix layer, wherein the second layer is the drug matrix layer, and wherein the optional top layer provides a controlled release of the bioactive agent.

The method of any previous embodiment, wherein the coating comprises polyester.

The method of any previous embodiment, wherein the coating comprises a bioabsorbable polymer selected from the group consisting of poly(lactic acid) (PLA), poly(lactic-co-glycolic acid) (PLGA), or a combination thereof, or wherein the coating comprises a biodurable polymer selected from the group consisting of polyacrylate, polymethacrylate, polyether, or a fluorinated polymer.

The method of any previous embodiment, wherein the coating comprises a biobeneficial material that enhances biocompatibility of the coating.

The method of any previous embodiment, wherein the coating comprises choline.

The method of any previous embodiment, wherein the coating comprises a pro-inflammatory material that generates a transient and mild inflammation.

The method of any previous embodiment, wherein the coating comprises an acid polyester or a filler material or particles.

The method of any previous embodiment, wherein the coating comprises a lubricant layer on top of a polymer layer.

The method of any previous embodiment, further comprising forming a lubricant layer on top of the second layer, wherein a pro-inflammatory material is embedded within the lubricant layer.

The method of any previous embodiment, wherein the coating includes a lubricant layer that possesses inherent pro-inflammatory properties.

The method of any previous embodiment, wherein the endovascular device is a detachable aneurysm coil.

The method of any previous embodiment, wherein the endovascular device is a platinum coil.

The method of any previous embodiment, further comprising using pre-stretching or without pre-stretching techniques to form the coating.

The method of any previous embodiment, further comprising an optional step that precedes all coating steps, which optional step comprises direct modification of the metal surface such that it increases the adhesion of the coating to the metal surface.

A method of treating or ameliorating a medical condition, comprising implanting in a mammalian subject in need thereof an endovascular device according to any previous embodiment.

The method of any previous embodiment, wherein the medical condition is intracranial aneurysm rupture or unruptured aneurysm.

1. A method of forming a coating on an endovascular spiral coil having a plurality of coil segments each separated by a helical gap, the method comprising: providing a solution comprising a polymeric coating; atomizing the polymeric coating a into a plurality of droplets at a set distance from the spiral coil; and coating an external surface of the spiral coil with the plurality of polymeric coating droplets; wherein the droplets have a size smaller than the helical gap separating the plurality of coil segments such that internal surfaces with respect to the helical gap remain substantially free of occlusion by the polymeric coating.

2. The method of any previous embodiment, wherein the helical gap comprises a resting gap distance when disposed in an unloaded state, the method further comprising: prior to coating the external surface, applying an axial tensile load on the spiral coil to expand the helical gap between the plurality of coil segments to an expanded distance greater than the resting gap distance.

3. The method of any previous embodiment, further comprising: adjusting droplet time-of-flight of the atomized polymeric coating according to the set distance from the spiral coil.

4. The method of any previous embodiment: wherein the solution comprises a solvent; and wherein the set distance from the spiral coil is selected as a function of droplet size and solvent content.

5. The method of any previous embodiment, wherein the size of the plurality of droplets is adjusted by adjusting one or more of: solution viscosity, solvent evaporation rate, distance from the spiral coil, rate of polymer deposition; solution surface tension, deposition air pressure, solution flow rate, and deposition rate.

6. The method of any previous embodiment, further comprising: depositing a layer of lubricant over the polymeric coating.

7. The method of any previous embodiment, further comprising: heating the polymeric coating to harden the coating.

8. The method of any previous embodiment, further comprising: irradiating the polymeric coating to induce polymer cross-linking within the coating.

9. The method of any previous embodiment, wherein the polymeric layer comprises a bioactive agent configured to promote wound healing.

10. A method of forming a coating on an endovascular spiral coil, the spiral coil having a plurality of coil segments each separated by a helical gap, the method comprising: providing a solution comprising a polymeric coating; atomizing the polymeric coating into a plurality of droplets at a set distance from the spiral coil; wherein the helical gap comprises a resting gap distance when disposed in an unloaded state; applying an axial tensile load on the spiral coil to expand the helical gap between the plurality of coil segments to an expanded distance greater than the resting gap distance; and coating an external surface of the spiral coil with the plurality of polymeric coating droplets; wherein the droplets have a size smaller than the expanded helical gap distance separating the plurality of coil segments such that internal surfaces with respect to the helical gap remain substantially free of occlusion by the polymeric coating.

11. The method of any previous embodiment, further comprising: adjusting droplet time-of-flight of the atomized polymeric coating according to the set distance from the spiral coil.

12. The method of any previous embodiment: wherein the solution comprises a solvent; and wherein the set distance from the spiral coil is selected as a function of droplet size and solvent content.

13. The method of any previous embodiment, wherein the size of the plurality of droplets is adjusted by adjusting one or more of: solution viscosity, solvent evaporation rate, distance from the spiral coil, rate of polymer deposition; solution surface tension, deposition air pressure, solution flow rate, and deposition rate.

14. The method of any previous embodiment, further comprising: depositing a layer of lubricant over the polymeric coating.

15. The method of any previous embodiment, further comprising: heating the polymeric coating to harden the coating.

16. The method of any previous embodiment, further comprising: irradiating the polymeric coating to induce polymer cross-linking within the coating.

17. The method of any previous embodiment, wherein the polymeric layer comprises a bioactive agent configured to promote wound healing.

18. A system for generating a coating on an endovascular spiral coil having a plurality of coil segments each separated by a helical gap, the system comprising: a deposition nozzle for receiving a solution comprising a polymeric coating; the deposition nozzle configured for atomizing the polymeric coating into a plurality of droplets at a set distance from the spiral coil; the deposition nozzle further configured for coating an external surface of the spiral coil with the plurality of polymeric coating droplets; an actuator coupled to the deposition nozzle for modifying the set distance from the nozzle to the spiral coil; a processor coupled to the actuator and deposition nozzle; and programming executable on the processor for: adjusting position and deposition characteristics of the deposition nozzle to adjust the size of the plurality of droplets to have a size smaller than the helical gap separating the plurality of coil segments.

19. The system of any previous embodiment, wherein the programming is further configured for: adjusting droplet time-of-flight of the atomized polymeric coating according to the set distance from the spiral coil.

20. The system of any previous embodiment, wherein the programming is further configured for: adjusting the size of the plurality of droplets by controlling one or more of: solution viscosity, solvent evaporation rate, distance from the spiral coil, rate of polymer deposition; solution surface tension, deposition air pressure, solution flow rate, and deposition rate.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural, chemical, and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A method of forming a coating on an endovascular spiral coil having a length and a plurality of adjacent coil segments each separated by a helical gap, wherein the helical gap comprises a substantially constant resting gap distance along the length of the coil when disposed in an unloaded state, the method comprising:

providing a solution comprising a polymeric coating;

applying an axial tension load on the spiral coil to expand the helical gap between the plurality of adjacent coil segments to an expanded distance greater than the resting gap distance;

atomizing the polymeric coating into a plurality of droplets at a set distance from the spiral coil; and coating an external surface of the spiral coil with the plurality of polymeric coating droplets;

wherein the droplets have a size smaller than the helical gap separating the plurality of adjacent coil segments such that internal surfaces with respect to the helical gap remain substantially free of occlusion by the polymeric coating.

2. A method as recited in claim 1, further comprising:

adjusting droplet time-of-flight of the atomized polymeric coating according to the set distance from the spiral coil.

3. A method as recited in claim 2:

wherein the solution comprises a solvent; and wherein the set distance from the spiral coil is selected as a function of droplet size and solvent content.

4. A method as recited in claim 2, wherein the size of the plurality of droplets is adjusted by adjusting one or more of: solution viscosity, solvent evaporation rate, distance from the spiral coil, rate of polymer deposition; solution surface tension, deposition air pressure, solution flow rate, and deposition rate.

5. A method as recited in claim 1, further comprising:

depositing a layer of lubricant over the polymeric coating.

6. A method as recited in claim 1, further comprising:

heating the polymeric coating to harden the coating.

7. A method as recited in claim 1, further comprising:

irradiating the polymeric coating to induce polymer cross-linking within the coating.

8. A method as recited in claim 1, wherein the polymeric layer comprises a bioactive agent configured to promote wound healing.

9. A method of forming a coating on an endovascular spiral coil, the spiral coil having a plurality of adjacent coil segments each separated by a helical gap, the method comprising:

providing a solution comprising a polymeric coating;

atomizing the polymeric coating into a plurality of droplets at a set distance from the spiral coil;

wherein the helical gap comprises a substantially constant resting gap distance along the length of the coil when disposed in an unloaded state;

applying an axial tensile load on the spiral coil to expand the helical gap between the plurality of adjacent coil segments to an expanded distance greater than the resting gap distance; and coating an external surface of the spiral coil with the plurality of polymeric coating droplets;

wherein the droplets have a size smaller than the expanded helical gap distance separating the plurality of adjacent coil segments such that internal surfaces with respect to the helical gap remain substantially free of occlusion by the polymeric coating.

10. A method as recited in claim 9, further comprising:

adjusting droplet time-of-flight of the atomized polymeric coating according to the set distance from the spiral coil.

11. A method as recited in claim 10:

wherein the solution comprises a solvent; and wherein the set distance from the spiral coil is selected as a function of droplet size and solvent content.

12. A method as recited in claim 10, wherein the size of the plurality of droplets is adjusted by adjusting one or more of: solution viscosity, solvent evaporation rate, distance from the spiral coil, rate of polymer deposition; solution surface tension, deposition air pressure, solution flow rate, and deposition rate.

13. A method as recited in claim 9, further comprising:

depositing a layer of lubricant over the polymeric coating.

14. A method as recited in claim 9, further comprising:

heating the polymeric coating to harden the coating.

15. A method as recited in claim 9, further comprising:

irradiating the polymeric coating to induce polymer cross-linking within the coating.

16. A method as recited in claim 9, wherein the polymeric layer comprises a bioactive agent configured to promote wound healing.

* * * * *